United States Patent [19]

Biaggi

[11] 4,433,721

[45] Feb. 28, 1984

[54] SPACER GRID FOR SUPPORTING ROD-SHAPED MEMBERS

[75] Inventor: Armando Biaggi, Winterthur, Switzerland

[73] Assignee: Sulzer Brothers Limited, Winterthur, Switzerland

[21] Appl. No.: 289,240

[22] Filed: Aug. 3, 1981

[30] Foreign Application Priority Data

Aug. 6, 1980 [CH] Switzerland ..... 5945/80

[51] Int. Cl.[3] ..... F28F 9/00

[52] U.S. Cl. ..... 165/162; 376/442

[58] Field of Search ..... 165/162; 122/510; 376/441, 442, 462

[56] References Cited

U.S. PATENT DOCUMENTS 3,164,529 1/1965 Waine et al. ..... 165/162 X

FOREIGN PATENT DOCUMENTS 1364849 5/1964 France ..... 165/162

367842 4/1963 Switzerland ..... 165/162

*Primary Examiner*—William R. Cline

*Assistant Examiner*—Theophil W. Streule, Jr.

*Attorney, Agent, or Firm*—Kenyon & Kenyon

[57] ABSTRACT

The grid for the parallel rows of tubes is composed of metal guide strips and spacer strips. The guide strips are disposed in pairs with semi-cylindrical portions defining circular openings for the tubes. The spacer strips are formed with bent portions to bear against the semi-cylindrical portions of the guide strips as well as rectilinear portions which are radial to the tubes.

8 Claims, 3 Drawing Figures

SPACER GRID FOR SUPPORTING ROD-SHAPED MEMBERS

This invention relates to a spacer grid for supporting rod-shaped members. More particularly, this invention relates to a spacer grid for supporting a plurality of parallel rod-shaped members.

Heretofore, it has been known to use spacer grids to support spaced apart parallel rod-shaped members through which a fluid heat vehicle flows longitudinally, for example tubes of a heat exchanger of fuel element rods of a nuclear reactor. Generally, these spacer grids having been constructed of interconnected metal strips which extend between the rod-shaped members. In some cases, the metal strips are disposed crosswise between the rod-shaped members of a bunch of such members. Thus, as these metal strips are largely situated completely in the flow of the heat vehicle, the heat vehicle experiences a considerable pressure drop at the metal strips.

Accordingly, it is an object of the invention to provide a spacer grid which gives the minimum pressure drop.

It is another object of the invention to provide a spacer grid for a bunch of parallel rod-shaped members which uses components of relatively thin and narrow construction.

Briefly, the invention provides a spacer grid for supporting a plurality of parallel rod-shaped members which is made of strips. In particular, pairs of guide strips are disposed in abutting relation to support a respective row of rod-shaped members with each guide strip having alternating substantially semi-cylindrical portions and flat portions. Each semi-cylindrical portion of a strip is disposed opposite a semi-cylindrical portion of the other strip to define a circular opening to receive a rod-shaped member. In addition, the grid has a plurality of spacer strips each of which is disposed in parallel relation to and between two adjacent pairs of guide strips. Each spacer strip has alternating bent portions and rectilinear portions with each bent portion bearing against a respective semi-cylindrical portion of an adjacent guide strip.

Since the guide strips and the spacer strips have the major part of their length in contact with the rod-shaped members, i.e. they are situated in the heat vehicle flow boundary layer, the flow profile between the rod-shaped members experiences relatively little disturbance and, thus, the pressure drop at the spacer grid is kept small.

Another advantage of the spacer grid is that the guide strips bear against the periphery of the rod-shaped members and the spacer strips bear against the semi-cylindrical bent portions of the guide strips. The free portions of the strips subjected to bending stress are short so that the strips can be made thin and narrow. This also reduces the pressure drop. In addition, the zone of the rod-shaped members that the strips obstruct from taking part in the heat transfer is reduced. Investment costs are also reduced.

Advantageously, the strips are interconnected by spot welding at the portions where they are in contact with one another.

In order to make the spacer grid sufficiently rigid in the various directions in which the grid extends, the spacer strips can be given a larger cross-section than the guide strips, which are in contact with one another in the zone between two semi-cylindrical bent portions, so that the total cross-section there is twice the cross-section of a bent portion.

The semi-cylindrical portions of the guide strips may have indentations extending towards the center of the opening to form point or linear supports for the rod-shaped members. These supports can be brought to the size corresponding to the diameter of the rod-shaped members by calibrating, i.e. by the insertion of appropriate tools, or by broaching, so that any dimensional errors can be corrected on the bending and assembly of the strips.

These and other objects and advantages of the invention will become more apparent from the following detailed description taken in conjunction with the accompanying drawings in which.

Figure 1:
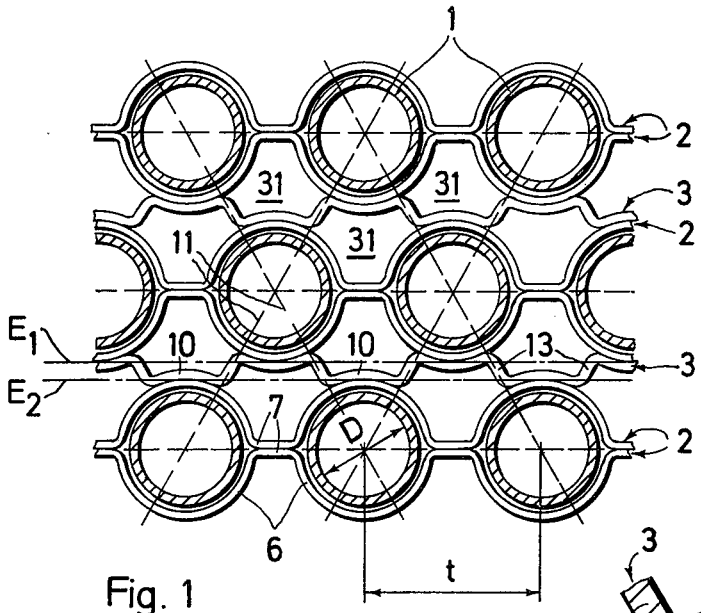
FIG. 1 illustrates a plan view of part of a spacer grid in accordance with the invention for tubes arranged in a triangular network.

Referring to FIG. 1, a bunch of parallel rod-shaped members, such as tubes 1, are disposed in parallel rows at a given pitch t and supported by a spacer grid composed of metal guide strips 2 and spacer strips 3 which are disposed in parallel relation to the rows of tubes 1.

Figure 2:
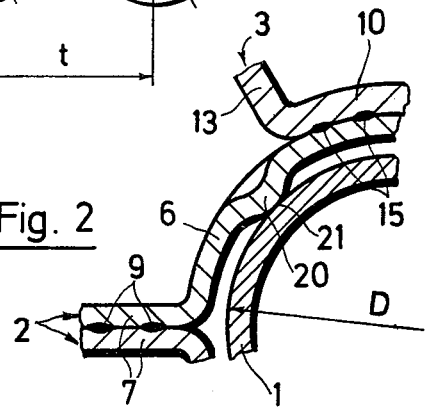
FIG. 2 illustrates a detail of the grid to a larger scale than FIG. 1.

The guide strips 2 are disposed in pairs and in abutting relation to support a row of tubes 1. As shown, each guide strip 2 has alternating substantially semi-cylindrical portions of recesses 6 and flat or rectilinear portions 7. The semi-cylindrical portions 6 are adapted to the tube pitch t and to the outside diameter D of the tubes 1 so that opposed semi-cylindrical portions 6 define a circular opening for a tube 1. The opposed facing flat portions 7 are in contact with each other and are rigidly interconnected, for example, mechanically, by means of screws (not shown) or by flanged over edges, or metallurgically by soldering or welding. As shown in FIG. 2, the flat portions 7 are welded together by resistance welding, i.e. spot welds 9.

Each spacer strip 3 is disposed between and to two adjacent pairs of guide strips 2 and has alternating bent portions 10 and rectilinear portions 13. Each bent portion 10 bears against a semi-cylindrical portion 6 and has a curvature adapted to the curvature of the bent portion 6 of a guide strip 2. The bent portions 10 are approximately situated alternately along two imaginary parallel planes $E_1$, $E_2$ parallel to the rows of tubes 1. The rectilinear portions 13 which connect the bent portions 10 are situated approximately on lines 11 connecting a network of triangles joining the center points of tubes 1 disposed in adjacent rows. As shown, each rectilinear portion 13 is disposed between two adjacent tubes 1 on an axis radial to each of these tubes 1.

As indicated in FIG. 2, the spacer strips 3 are rigidly connected via the bent portions 10 to the adjoining semi-cylindrical portions 6 of the guide strips 2 by spot welds 15. Thus, each spacer strip 3 joins two pairs of guide strips 2.

As shown in FIG. 2, the guide strips 2 have indentations 20 which form point or linear supports 21 for the tubes 1 which are to be supported by the spacing grid. These supports 21 can be adapted to the outside diameter D of the tubes 1 by broaching or calibrating.

FIGS. 1 and 2 show the distance between the tubes 1 and the bent portions 6 of the guide strips 2 on an exaggerated scale. In actual fact, the value of this distance is only of the order of magnitude of the expected bending tolerances. Consequently, the pressure drop at the spacing grid becomes minimal.

As seen from FIG. 1, the spacer strips 3 are thicker than the guide strips 2 because the guide strips 2 are doubled at the flat portions 7 which are not in contact with the tubes 1 and are therefore adequately reinforced.

The spacer grid as a whole, thus, has substantially cylindrical openings to receive the tubes 1 and approximately twice as many hexagon-like openings 31. Each tube 1 is supported relative to the adjacent tubes 1 by way of two doubled portions 7 of the guide strips 2 and four rectilinear portions 13 of the spacer strips 3. These rectilinear supports (7,13) are relatively short and thus form only a slight obstruction to the flow between the tubes 1.

It should be noted that the tubes 1 against which the portions 7 and 13 bear contribute considerably to reinforcing the spacer grid.

Figure 3:
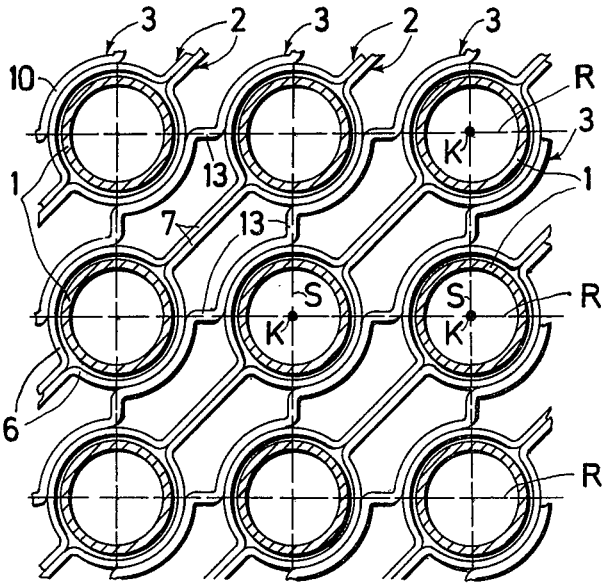
FIG. 3 illustrates a similar plan view to FIG. 1 showing a spacer grid for tubes arranged in a square pattern.

Referring to FIG. 3, wherein like reference characters indicate like parts as above, the tubes 1 may be in a square pattern on a grid R, S. In this embodiment, both the guide strips 2 and the spacer strips 3 of the supporting grid extend diametrically in relation to the grid R, S on whose points of intersection K the axes of the tubes 1 are situated. The construction of the strips 2 and 3 and their mutual arrangement and connection is the same as in the exemplified embodiment shown in FIGS. 1 and 2.

The invention thus provides a grid of strips which can be made of metal to rigidly support a bunch of parallel rod-shaped members while causing relatively little disturbance in the flow profile of a fluid heat vehicle flowing along the members.

What is claimed is:

1. A spacer grid for supporting a plurality of parallel rod-shaped members, said grid comprising pairs of guide strips disposed in abutting relation to support a respective row of rod-shaped member, each said guide strip having alternating substantially semi-cylindrical portions and flat portions with each semi-cylindrical portion of one strip disposed opposite a respective semi-cylindrical portion of the other strip to define a circular opening to receive a rod-shaped member; and a plurality of spacer strips, each said spacer strip being disposed in parallel relation to and between two adjacent pairs of guide strips, each said spacer strip having alternating bent portions and rectilinear portions with each bent portion bearing against a respective seim-cylindrical portion of an adjacent guide strip.

2. A spacer grid as set forth in claim 1 wherein said flat portions of each guide strip of a respective pair of guide strips are in contact with a facing flat portion.

3. A spacer grid as set forth in claim 1 wherein said guide strips of each respective pair of guide strips are welded to each other.

4. A spacer grid as set forth in claim 3 wherein said spacer strips and said guide strips are of equal width and said spacers strips are of greater thickness than said guide strips.

5. A spacer grid as set forth in claim 3 wherein said spacer strips each have a greater cross-sectional area than the cross-sectional area of each of said guide strips.

6. A spacer grid as set forth in claim 1 wherein said strips are each made of metal.

7. In combination, a bunch of parallel rod-shaped members disposed in parallel rows; and a spacer grid supporting said members in parallel relation, said grid comprising pairs of guide strips disposed in abutting relation to support a respective row of rod-shaped members, each said guide strip having alternating substantially semi-cylindrical portions and flat portions with each semi-cylindrical portion of one strip disposed opposite a respective semi-cylindrical portion of the other strip to define a circular opening to receive a rod-shaped member; and a plurality of spacer strips, each said spacer strip being disposed in parallel relation to and between two adjacent pairs of guide strips, each said spacer strip having alternating bent portions and rectilinear portions with each bent portion bearing against a respective semi-cylindrical portion of an adjacent guide strip.

8. The combination as set forth in claim 7 wherein each rectilinear portion of a spacer strip between two adjacent members is disposed on an axis radial to each said adjacent member.

* * * * *